US005879146A

United States Patent [19]

Van De Voort et al.

[11] Patent Number: 5,879,146

[45] Date of Patent: Mar. 9, 1999

[54] STEPPED WEAR INDICATOR FOR A RADIAL COMPRESSOR

[75] Inventors: Michael J. Van De Voort; Stephan B. Meydell, III, both of Appleton, Wis.

[73] Assignee: Delaware Capital Formation, Inc., Wilmington, Del.

[21] Appl. No.: 786,426

[22] Filed: Jan. 21, 1997

[51] Int. Cl.[6] ..... F04C 18/344; F04C 29/00

[52] U.S. Cl. ..... 418/2; 418/259

[58] Field of Search ..... 418/2, 209, 210, 418/252, 259, 266

[56] References Cited

U.S. PATENT DOCUMENTS

| | | | |
|---|---|---|---|
| 3,191,503 | 6/1965 | Fuehrer | 418/266 |
| 3,463,384 | 8/1969 | Kilbane | 418/2 |
| 3,469,500 | 9/1969 | Lutz et al. | 418/2 |
| 5,074,769 | 12/1991 | Kazaoka et al. | 418/266 |

FOREIGN PATENT DOCUMENTS

| | | | |
|---|---|---|---|
| 5-248378 | 9/1993 | Japan | 418/259 |

*Primary Examiner*—John J. Vrablik
*Attorney, Agent, or Firm*—Foley & Lardner

[57] ABSTRACT

The invention includes a wear indicator for a radially extensible vane compressor. The indicator is an elongate member having two longitudinal sections with a step inbetween. The step catches on a mating step formed in the compressor rotor when it is good and does not catch on the mating step when it is bad (i.e., worn). A repair person can test the wear of the indicator merely by attempting to withdraw the indicator. If it is removed it is worn, and if it is not removable, it is acceptable.

7 Claims, 5 Drawing Sheets

STEPPED WEAR INDICATOR FOR A RADIAL COMPRESSOR

FIELD OF THE INVENTION

The present invention relates generally to radially extensible vane compressors. More particularly, it relates to a system for monitoring the wear of vanes in radially extensible vane compressors.

BACKGROUND OF THE INVENTION

In the field of radially extensible vane compressors, vane wear is a common concern. Due to the great centrifugal forces acting on the vanes, and the great velocity differences between the vanes and the internal walls of the compressor housing that the vanes contact, vanes wear long before the other components of the compressor. Timing of vane replacement has a significant effect on operating costs of the vane compressor. In a typical chemical plant application, the entire process must be stopped for vanes to be replaced, the compressor must be disassembled, and the vanes checked and replaced as necessary. This results in significant downtime for the chemical processing plant, and typically all such repairs are made as rapidly as possible to allow the equipment to be reassembled and brought back up on line as soon as possible. Measuring vane wear typically requires the use of dial indicators, and other measuring instruments that may be easily misread or broken in the haste of checking and repairing the compressor. Alternatively, vane wear may be measured without significantly disassembling the compressor by removing an inspection port of the vane compressor, "bumping" the rotor until it is in the proper rotational position for each vane, and measuring the distance between the edge of the inspection port and the outermost wearing edge of the vane. As the vane wears, this distance will become greater and greater until it finally indicates the need for repair. This process has the disadvantage of requiring careful positioning of the rotor and manipulation of the depth gauge, and has the further disadvantage of requiring subsequent disassembly if the vanes are found to be in need of repair. What is needed is an improved method and apparatus for checking vane wear in a radially extensible vane compressor that is more accurate, that does not require expensive measuring instruments, and is less likely to be misread.

SUMMARY OF THE PRESENT INVENTION

The present invention provides a novel apparatus for measuring vane wear that provides for the above needs.

In accordance with a first embodiment of the invention, a wear indicator is provided having two longitudinal portions, one having an overall width of between 85% and 95% of the other, where the two longitudinal portions are joined at a step. The step may be perpendicular to a wearing edge, or it may be sloped to allow easy withdrawal when compressor wear is tested. The angle of slope is preferably between 3° and 20°, and more preferably between 6° and 16°. To allow easier gas exit from between the slot and the indicator, the transitional portion is preferably radiused, and more preferably has a radius of at least the overall width of the indicator. The step may be disposed at various positions along the length of the indicator to reduce wear caused by rubbing of the indicator step against a mating step on the compressor rotor. The positions at which vibration and therefore wear are minimized are 9%, 13%, 22%, 36%, 50%, 64%, 87% and 92% from either longitudinal end of the indicator.

Other principal features and advantages of the invention will become apparent to those skilled in the art upon review of the following drawings, the detailed description and the appended claims.

Figure 1:
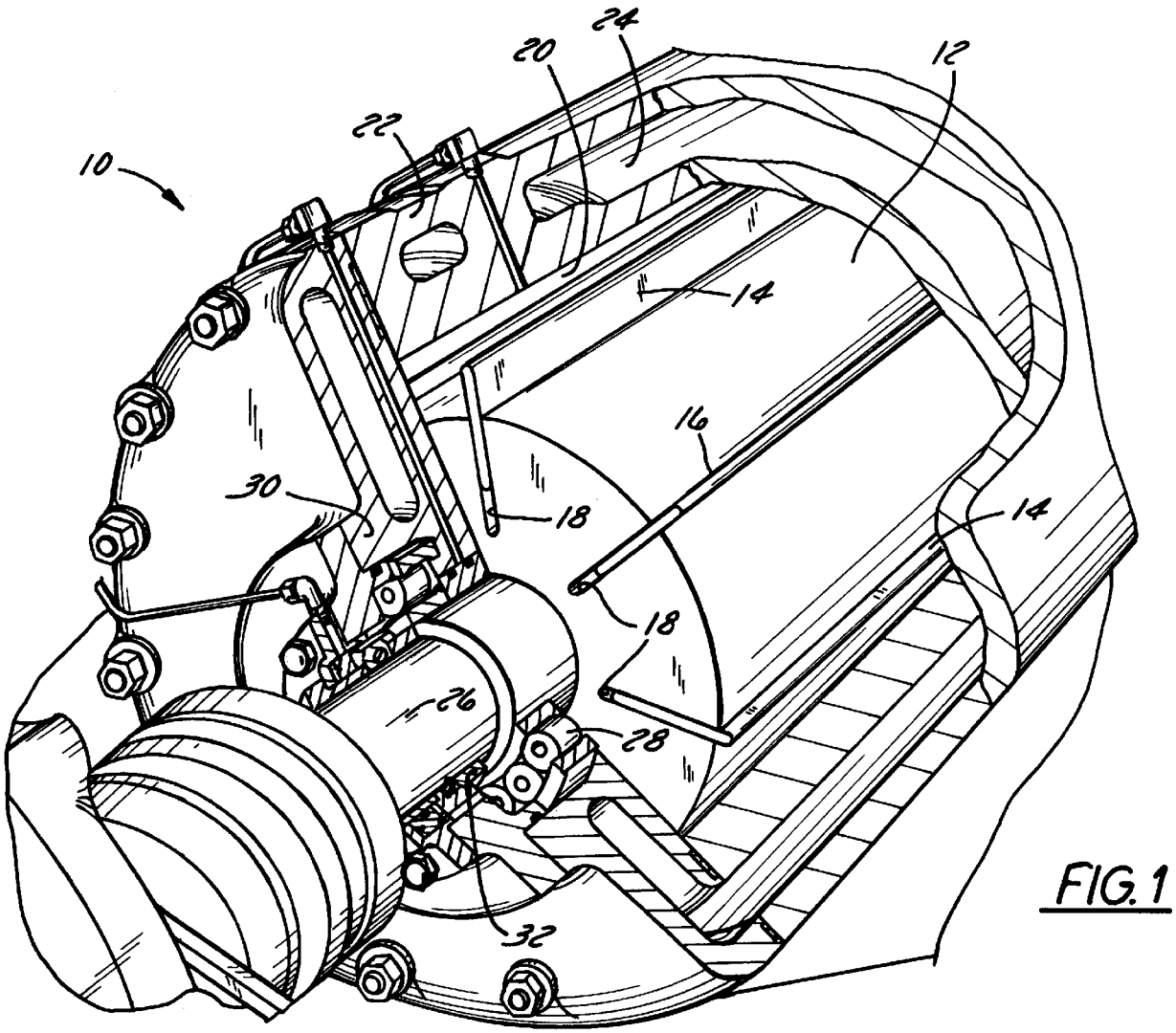
FIG. 1 is a partial cross-sectional perspective view of a compressor in accordance with the present invention.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

The subject of this application is generally radially extensible vane compressors. To describe the interrelationship and relative positions of various elements of the various embodiments, certain naming conventions have been chosen. In this description, therefore, the term "axial" refers to the axis of rotation of the compressor rotor. "Longitudinal" or "length" when used in reference to a wear indicator, refers to the extent of a wear indicator in a direction parallel to the rotational axis of the rotor in which the indicator is fitted; this is the largest overall dimension. "Thickness" when used in reference to a wear indicator, refers to the extent of the indicator in a direction orthogonal to its length and width. This is the smallest overall dimension of the wear indicator. "Width" when used in reference to a wear indicator, refers to the extent of the indicator in a direction generally perpendicular to the rotational axis of the rotor in which it is installed. Thickness, length and width, therefore, define three orthogonal extents of the wear indicator.

Turning now to the drawings, FIG. 1 discloses a partial cutaway view of a radially extensible vane compressor in accordance with the present invention. Compressor 10 includes a rotor 12 and vanes 14 and indicator 16 disposed in slots 18 in rotor 12. Here, only three of the eight equiangularly spaced slots are shown. The rotor and vanes rotate within rotor chamber 20 in compressor housing 22. Water passageways 24 are provided between the inner and outer surfaces of housing 22 to contain compressor cooling water. A shaft 26 extending from one end of the rotor passes through the end of housing 22 and through roller bearing 28 in end cover 30. Seals 32 are disposed in end cover 30 and contact shaft 26 to prevent gas leakage. A similar end cover supporting a similar bearing and seal and rotationally supporting a similar shaft extending from the opposing end of the rotor are similarly disposed at the opposing end of the housing. It can be seen that in this compressor, the vanes can only be removed by first removing an end cover of the compressor. Once the end cover is removed, the vanes and the wear indicator can be translated in the slots in a direction parallel to the axis of rotation of the rotor until they are removed from the compressor housing itself.

Figure 2:
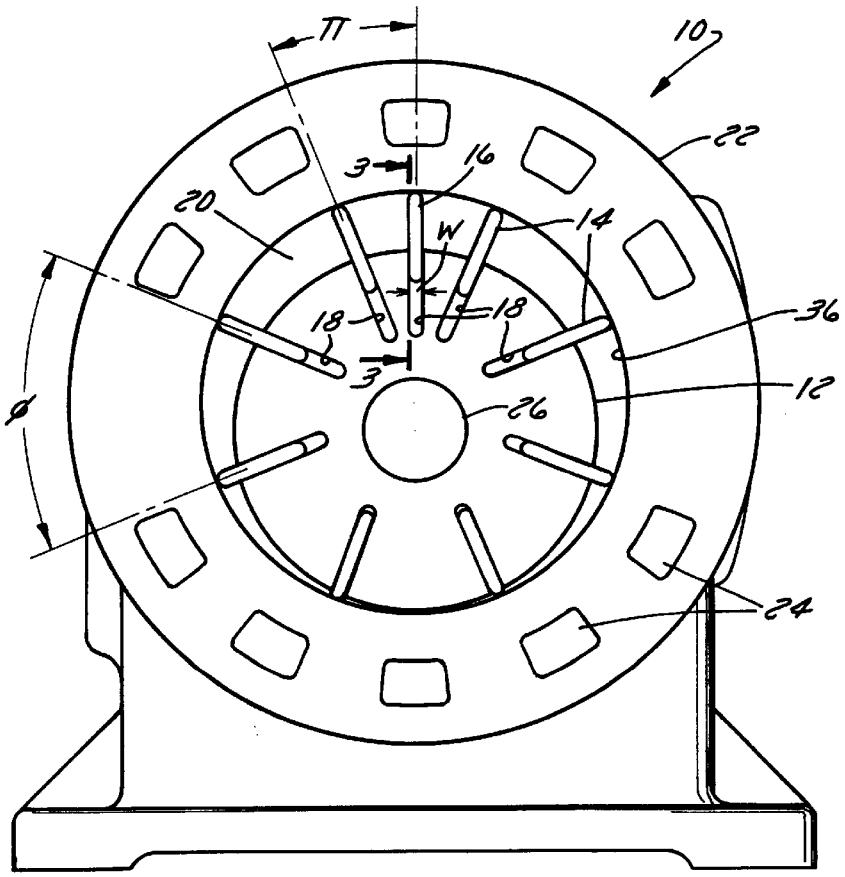
FIG. 2 is an end view of the FIG. 1 compressor with an end cover removed.

FIG. 2 is an end view of compressor housing 22 of FIG. 1 illustrating the arrangement of vanes 14 and wear indicator 16 slidingly disposed in slots in the rotor. Eight vanes are disposed in eight slots equiangularly spaced about the rotor. An additional slot 18 is provided for the vane wear indicator 16. The slot in which the wear indicator is disposed preferably has a width W equal to the width of the slots holding vanes 14. The wear indicator is disposed between two of the vanes in the rotor at an angle pi equal to one-half that of angle phi which defines the angular spacing between each adjacent pair of vanes. Since this embodiment has eight vanes, phi is 45° and pi is 22.5°. Although the embodiments shown herein are of compressors with eight vanes, twelve vane compressors with 30° equidistantly spaced vanes would also benefit from the use of wear indicators. In a twelve vane compressor, the equidistant vane spacing is 30°, and a wear indicator would preferably be provided at a position equidistant between two adjacent vanes.

Figure 3:
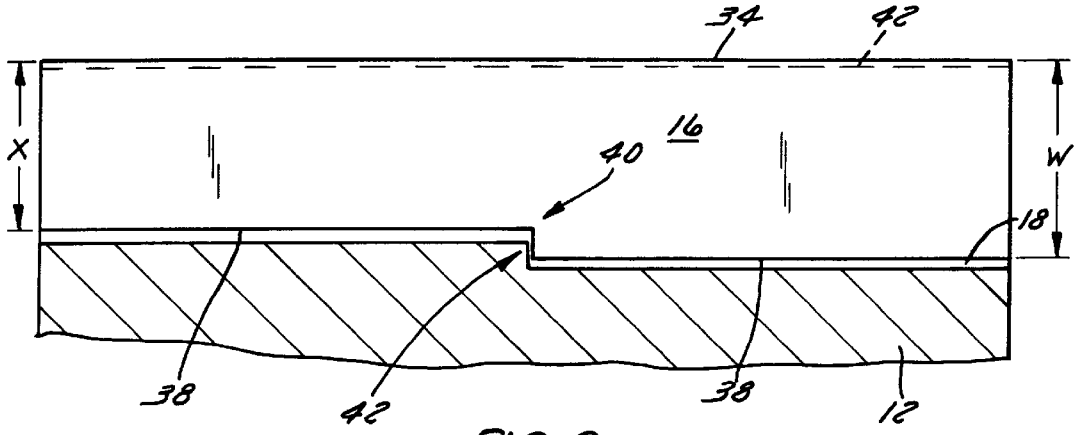
FIG. 3 is a sectional view of the rotor of the embodiment shown in FIGS. 1 and 2.

FIG. 3 illustrates a plan view of wear indicator 16 and a sectional view of rotor 12 taken at Section 3—3 in FIG. 2. Wear indicator 16 is shown here inserted almost to the bottom of slot 18 of rotor 12 in which it is disposed. Wear indicator 16 has a wearing edge 34 that is disposed against inner cylindrical surface 36 (FIG. 2) of housing 22. Slot edge 38 opposes wearing edge 34 and is adapted to be received in slot 18 in rotor 12. Slot edge 38 has a step 40 disposed substantially midway along the length of wear indicator 16. Step 40 divides the vane into two longitudinal portions, a wider portion having an overall width W and a narrower portion having an overall width X, where X preferably ranges between 85% and 95% of W. A mating step 42 is provided in rotor 12 at the bottom of slot 18 to engage with step 40 on wear indicator 16.

Figure 4:
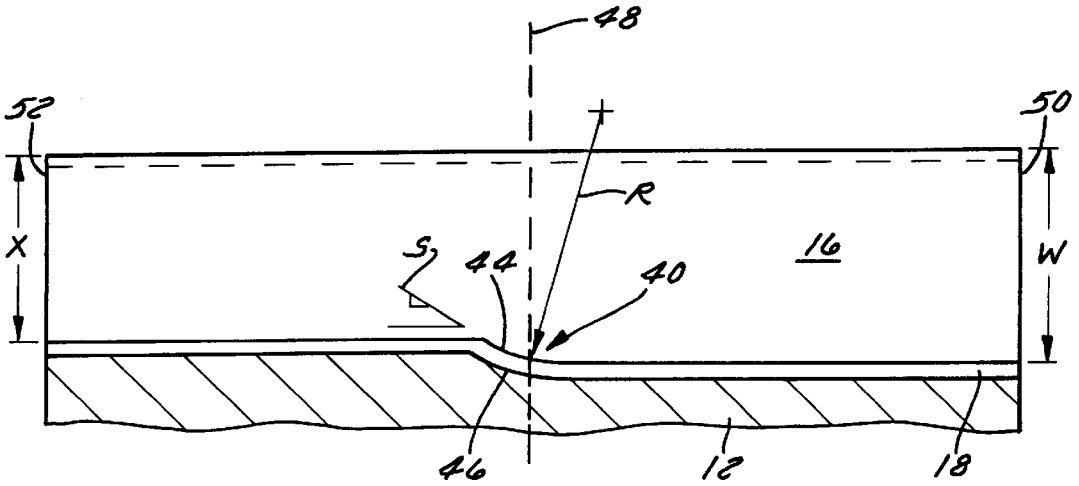
FIG. 4 is a sectional view of a rotor similar to the rotor of FIG. 3 and an alternative wear indicator.

FIG. 4 illustrates an alternative embodiment of wear indicator 16. Wear indicator 16 is similarly inserted into slot 18 in rotor 12. In this embodiment, however, step 40 is provided by a transitional portion 44 of slot edge 38 having a radius of curvature R at least as great as the overall width W of wear indicator 16. This radius allows the gas otherwise trapped behind indicator 16 to flow smoothly out from between the indicator and its slot when the indicator is forced back into the slot. Transitional portion 44 preferably has an overall slope S of between 3° and 20°, and more preferably between 6° and 16°. This slope provides a downward force on indicator 16 whenever a repairman checks the vane wear by attempting to withdraw the indicator as described below in conjunction with FIGS. 6–8. If step 40 was abrupt, as seen in FIG. 3, it may catch on mating step 42 even if the indicator is worn sufficiently. This would lead a repairman to believe the indicator is not sufficiently worn, when in fact it is. This transitional portion 44 mates with similarly radiused portion 46 of the bottom of slot 18. As in the previous example, step 40 subdivides the longitudinal extent of wear indicator 16 into a portion with an overall width W and a portion with an overall width X equal to 85% to 95% of W.

The longitudinal positioning of step 40 is critical to the proper operation of the wear indicator. As can be seen in FIG. 4, the transitional portion 44 is disposed to intersect the longitudinal midpoint of wear indicator 16, here identified as 48. As the rotor rotates within the compressor cavity, opposing ends 50, 52 of wear indicator 16 make intermittent contact with covers 30 (FIG. 1). Covers 30 contact ends 50, 52 intermittently during the operation of the compressor applying rubbing forces in a direction parallel to the thickness of the wear indicator as the compressor operates. Since the thickness is the smallest overall dimension, and since the covers apply rubbing forces to opposing ends perpendicular to the greatest extent of the indicator, wear indicator 16 will flex within slot 18 in several oscillatory modes of vibration much as a diving board flexes when a diver leaps. Since opposing ends 50, 52 of wear indicator 16 are free to laterally translate within slot 18, and since the forces the opposing end covers apply are parallel to the thickness of the wear indicator, the wear indicator oscillates like a free beam.

Figure 5A:
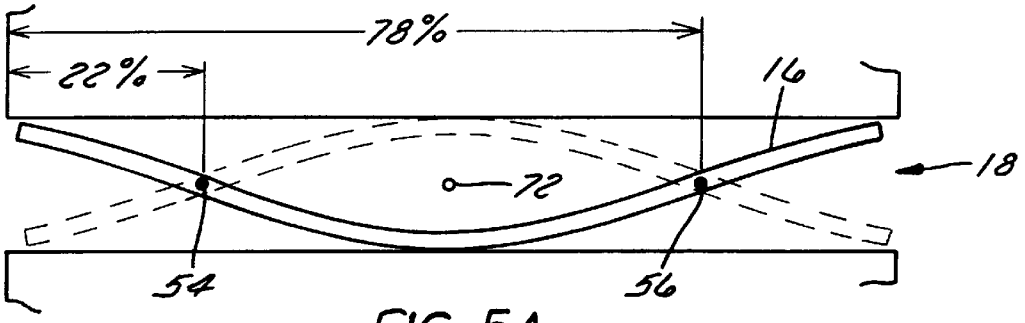
FIGS. 5A–C are schematic representations of wear indicator oscillation modes.
Figure 5B:
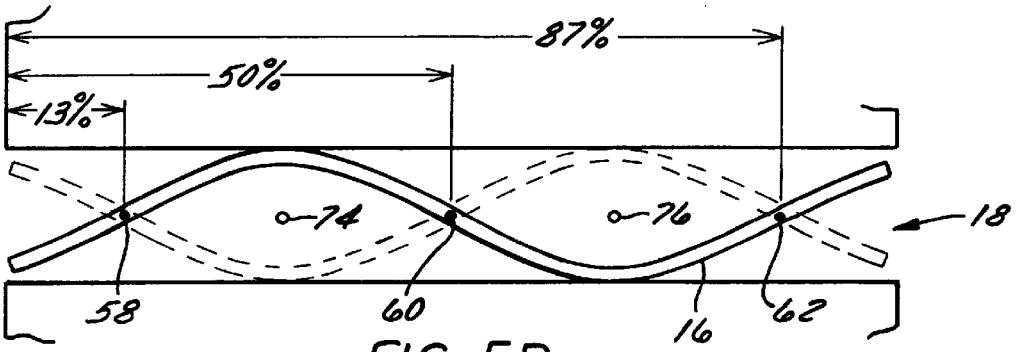
Figure 5C:
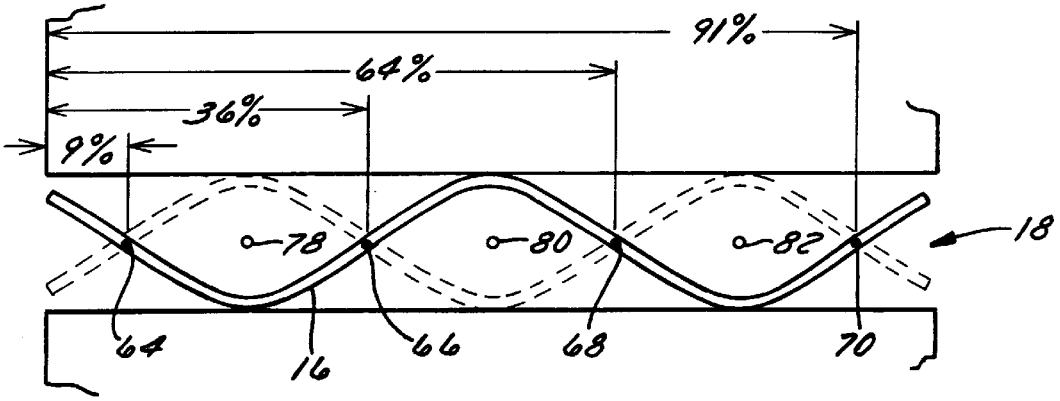

To illustrate the manner in which the indicator oscillates as a free beam, FIGS. 5A–C have been provided. These figures illustrate a top view of slot 18 in which indicator 16 is disposed. Each figure illustrates two extreme positions of indicator 16 as it oscillates side to side in slot 18. One such position is shown as a solid outline of indicator 16 and the other is shown as a dashed outline of indicator 16 that is superimposed on the solid outline. The width of slot 18 and the magnitude of the oscillation are enlarged to more clearly indicate the different vibratory modes. These figures show the primary modes of oscillation of indicator 16 within slot 18 schematically in several oscillating modes. The ends of the indicator are not constrained and so it can be modeled as a vibrating beam having both ends free. A beam with two free ends, such as the indicator, has nodes 54, 56, 58, 60, 62, 64, 66, 68 and 70, where lateral vibration of indicator 16 (i.e., vibration side to side in slot 18) approaches zero, and maxima 72, 74, 76, 78, 80 and 82, where the lateral vibration of indicator 16 has its greatest magnitude. FIGS. 5A–C differ from each other in the number of nodes and maxima and in the frequency of oscillation. Specifically, FIGS. 5A–C illustrate the first, second and third modes of harmonic oscillation of a free beam, respectively. The Applicants consider these to be the dominant modes of harmonic oscillation for a typical indicator.

If the indicator vibrates in any of these modes of oscillation, and if step 40 or transitional portion 44 is disposed at one of these maxima, the step or transition portion in intimate contact with step 42 or portion 46 will experience significant wear. Conversely, locating step 40 or transition portion 44 at a node will minimize this wear. For this reason, the transition portion should be disposed at a local node in the preferred embodiment.

The position of a node depends upon the indicator's mode of oscillation as can be seen by comparing FIGS. 5A, 5B and 5C. FIG. 5A schematically illustrates the indicator in its first harmonic mode of oscillation. This is the most simple mode of harmonic oscillation, with nodes 54 and 56 located approximately 22% and 78% of the distance along the length of the indicator. In the second harmonic mode shown in FIG. 5B, nodes 58, 60 and 62 are respectively located approximately 13%, 50% and 87% of the total distance along the length of the indicator. In the third harmonic mode shown in FIG. 5C, nodes 64, 66, 68 and 70 are respectively located approximately 9%, 36%, 64% and 92% of the total distance along the length of the indicator. To minimize wear between transition portion 44 of the indicator and portion 46 of the bottom of slot 18 with which it is engaged, portions 44 and 46 should be located at these nodal positions. Thus, step 40 and transition portion 44 of indicator 16 should be located on the slot edge at a position either 9%, 13%, 22%, 36%, 50%, 64% 87% or 92% from one longitudinal end of the indicator depending upon the dominant node.

In FIG. 4, the transition portion clearly extends over a portion of the length of indicator 16, unlike the embodiment shown in FIG. 3. Since the entire length of the transition portion in FIG. 4 cannot be located entirely at a node, there will be some vibration and wear. By locating at least a portion of transitional portion 44 at a node, however, the amount of wear will be reduced significantly.

The indicator provides a reliable indication of vane wear in the compressor only if it is worn away in a manner proportionate to the wear of the other vanes in the compressor during operation. For this reason, the indicator is preferably made of the same or similar material as the vanes and preferably has the same or a substantially similar coefficient of wear as the other vanes in the compressor. For example, the wear indicator may be a composite such as a resin impregnated asbestos cloth (fiber-reinforced resins) or may be made of nonreinforced engineering plastics such as PAI, PEEK and PPS. Locating the step or transitional portion thereof at the nodal positions identified above is of particular value when using nonreinforced plastics, since they are extremely flexible when compared to fiber-reinforced plastics, and thus have a much higher amplitude of oscillation given the same inputs.

Figure 6:
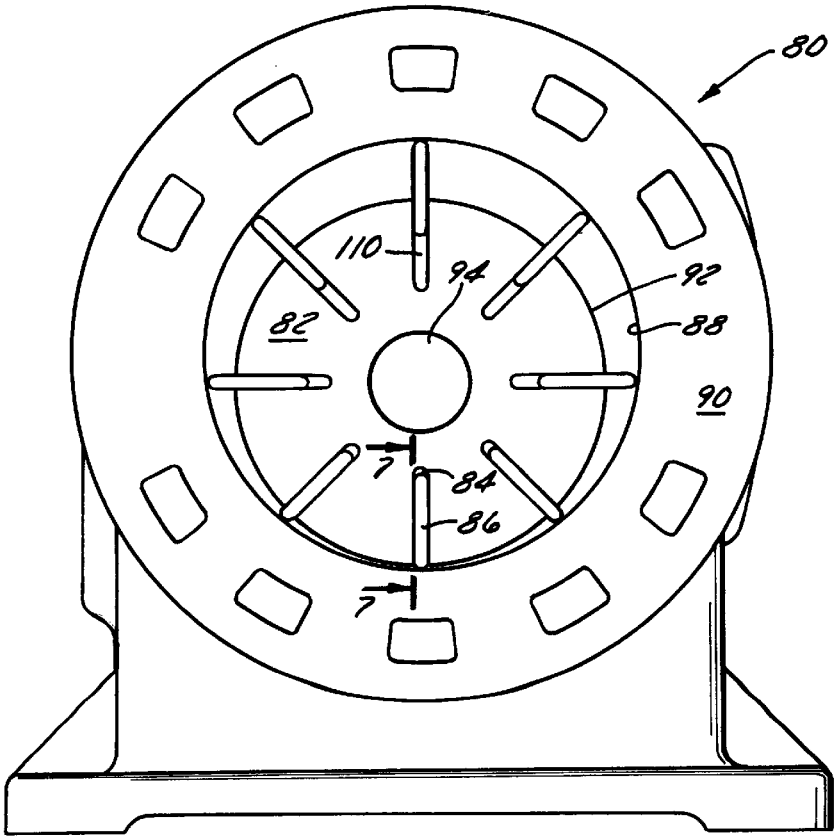
FIG. 6 is an end view of another compressor utilizing a wear indicator with its end cover removed.
Figure 7:
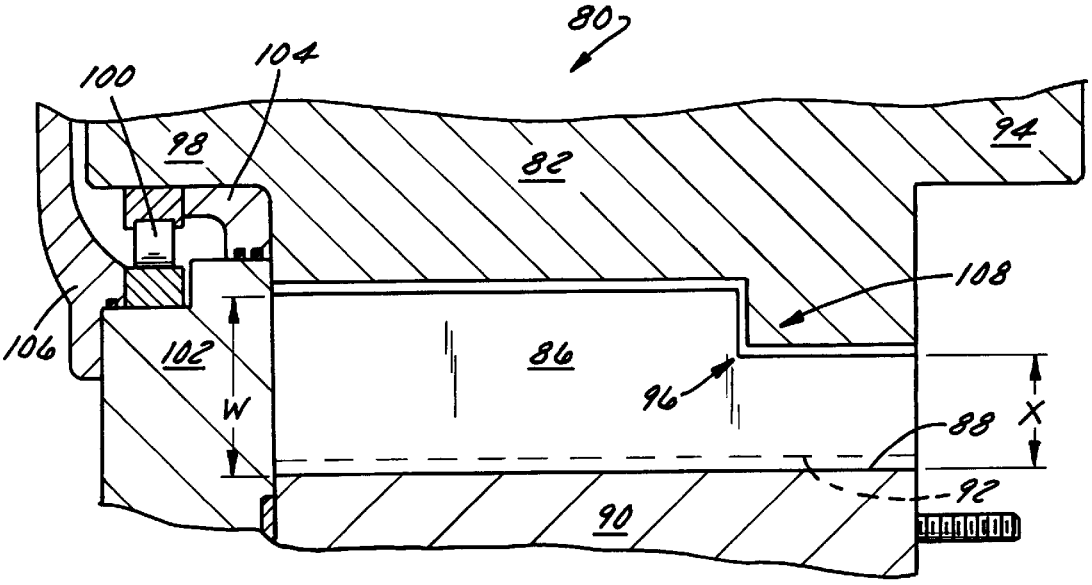
FIG. 7 is a sectional view of the FIG. 6 embodiment.
Figure 8:
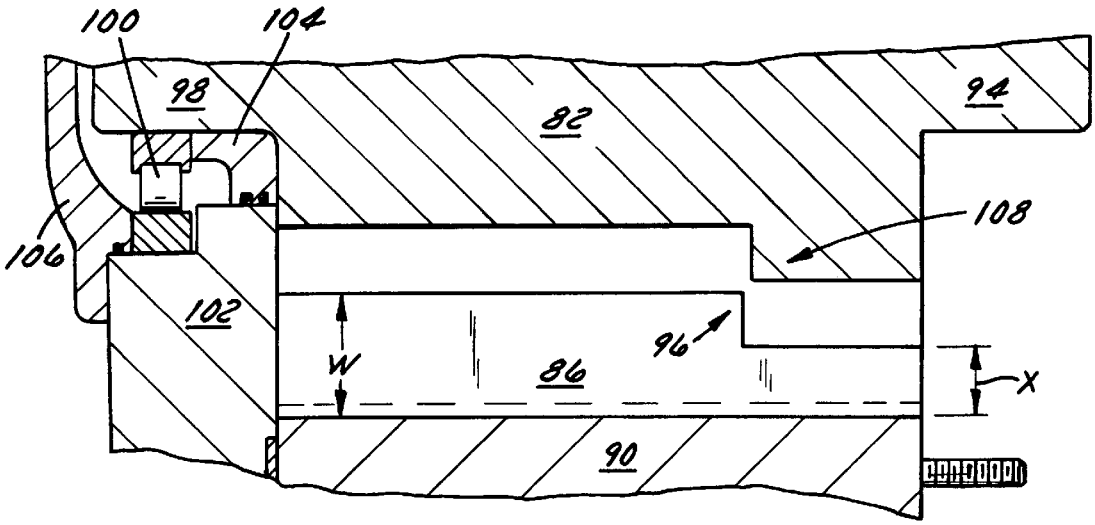
FIG. 8 is a sectional view of the indicator and rotor of the FIG. 7 compressor after significant indicator wear.

FIGS. 6–8 illustrate the manner in which the wear indicator is used to indicate wear. FIG. 6 shows an end view of a compressor 80 with a cover removed from the end facing the viewer. Rotor 82 has a slot 84 in which wear indicator 86 is disposed. In this embodiment wear indicator 86 is disposed angularly equidistant from the other vanes of the compressor. Rotor 82 is shown rotationally oriented so that slot 84 is near the bottom of rotor 82. Indicator 86 rests against the bottom inner surface 88 of compressor housing 90. In the lowermost position of slot 84, a slight gap or "bottom clearance" is provided between outer cylindrical surface 92 of rotor 82 and inner surface 88 of housing 90. Rotor shaft 94 extends outwardly from rotor 82. In other compressors of this type, the rotor is offset toward the top, rather than the bottom of the compressor housing, and thus the clearance would be "top clearance."

FIG. 7 is a partial cross-sectional view of the FIG. 6 embodiment at Section 7—7, showing the position of indicator 86 and its step 96 with respect to rotor 82. Rotor 82 has a shaft 98 extending from one end that is supported by bearing 100 mounted in cover 102. Seal ring 104 is mounted on shaft 98 and prevents gas from leaking out of the compressor. Cap 106 seals the end of cover 102. In this view, it can be seen that indicator 86 cannot be withdrawn from slot 84 since step 108 on rotor 82 engages step 96 on indicator 86.

FIG. 8 illustrates the FIGS. 6–7 compressor after indicator 86 has worn significantly. Due to its wear, the overall width W of indicator 86 is reduced. This smaller width allows the indicator to drop clear of step 108. In this position a repairman can easily slide it out of its slot. The indicator is worn enough to be replaced if it can be removed as described above.

Clearly, a new indicator cannot simply be inserted in the slot 84 since the greater width of a new wear indicator such as that shown in FIG. 7 will interfere with step 108 and prevent the wear indicator from being inserted into slot 84. To surmount this problem, rotor 82 is simply rotated until slot 84 is spaced away from the inner surface 88 of compressor housing 90, such as the uppermost position 110 shown in FIG. 6. When rotor 82 is rotated to move slot 84 into position 110, a sufficient space between the step 108 of rotor 82 and the inner surface 88 of housing 90 will allow the indicator to be inserted into slot 84.

When a single vane is worn enough to need replacing, typically all the vanes are replaced. For this reason, if the wear indicator indicates that a vane needs replacing, typically all the vanes are replaced, since all the vanes will have substantially the same amount of wear. Replacing the vanes in the embodiment of FIGS. 6–8 is a simple process. Since the other vanes in compressor 80 are typically not provided with the stepped construction of indicator 86 and slot 84, the other vanes are easily removed simply by pulling them out of their respective slots. In other compressor applications, it may be more cost effective to replace each vane as it is worn rather than using a single wear indicator as a signal to replace all of the vanes. In such a compressor all of the slots in rotor 82 would be provided with the stepped structure of slot 84. In this manner, an indicator could be substituted for every standard vane in the compressor, and each indicator can be individually tested and replaced as necessary. Although compressor 80 is illustrated having an abrupt step, a transitional step such as that shown in FIG. 4 could be substituted. In addition, the relative widths W, X of indicator 86 are preferably the same as described for indicator 16 and the longitudinal position of step 96 is preferably the same as that of indicator 16.

Thus, it should be apparent that there has been provided in accordance with the present invention a vane wear indicator that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A wear indicator for a radially extensible vane compressor, having a rotor with a first step in a vane receiving groove comprising:

a first longitudinal portion having a first overall width;

a second longitudinal portion having a second overall width equal to 85%–95% of the first overall width; and a stepped portion countable with the first step and longitudinally disposed between the first and second longitudinal portions, wherein the length of the first, second and stepped portions extends substantially the entire length of the vane.

2. The wear indicator of claim 1, wherein the stepped portion is disposed at a longitudinal position selected from the group consisting of 9%, 13%, 22%, 36%, 50%, 64%, 87% and 92% from one longitudinal end of the wear indicator.

3. The wear indicator of claim 2, wherein the stepped portion includes a longitudinally sloped transitional portion.

4. The wear indicator of claim 3, wherein the stepped portion has a radius.

5. The wear indicator of claim 4, wherein the radius is at least as great as the overall width of the wear indicator.

6. The wear indicator of claim 3, wherein the transitional portion has an overall slope of between 3° and 20°.

7. The wear indicator of claim 6, wherein the transitional portion has an overall slope of between 6° and 16°.

* * * * *